US008308039B2

(12) United States Patent
Wei

(10) Patent No.: US 8,308,039 B2
(45) Date of Patent: Nov. 13, 2012

(54) CLAMPING MECHANISM FOR AN AUTO HAMMER

(75) Inventor: Gan Wei, Jiangsu (CN)

(73) Assignee: Chervon Limited (HK)

( * ) Notice: Subject to any disclaimer, the term of this patent is extended or adjusted under 35 U.S.C. 154(b) by 341 days.

(21) Appl. No.: 12/700,008

(22) Filed: Feb. 4, 2010

(65) Prior Publication Data

US 2011/0121048 A1 May 26, 2011

(30) Foreign Application Priority Data

Nov. 20, 2009 (CN) ..... 2009 1 0234461

(51) Int. Cl.
*B25C 1/06* (2006.01)

(52) U.S. Cl. ..... 227/147; 227/149; 227/119; 81/463; 81/464; 269/229; 269/236; 269/3; 269/6; 29/278; 29/274; 29/270; 279/71; 279/74; 279/81; 279/82

(58) Field of Classification Search ..... 227/147, 227/149, 119; 81/463, 464; 269/229, 236, 269/3, 6; 29/278, 274, 270; 279/71, 74, 279/81, 82
See application file for complete search history.

(56) References Cited

U.S. PATENT DOCUMENTS

| | | | | |
|---|---|---|---|---|
| 1,772,224 | A * | 8/1930 | Peterson | 81/325 |
| 2,079,909 | A | 5/1937 | Corwill | |
| 2,877,820 | A | 3/1959 | Ristow | |
| 3,160,217 | A | 12/1964 | Raihle | |
| 3,376,940 | A | 4/1968 | Willis | |
| 3,924,692 | A | 12/1975 | Saari | |
| 4,299,021 | A | 11/1981 | Williams | |
| 4,378,053 | A * | 3/1983 | Simpson | 173/13 |
| 4,742,875 | A | 5/1988 | Bell | |
| 4,908,909 | A | 3/1990 | Akrenius | |
| 5,002,134 | A | 3/1991 | Yamada | |
| 5,443,196 | A | 8/1995 | Burlington | |
| 5,794,325 | A | 8/1998 | Fallandy | |
| 6,250,401 | B1 | 6/2001 | Yamada | |
| 6,431,430 | B1 | 8/2002 | Jalbert et al. | |
| 6,866,226 | B2 | 3/2005 | Pratt et al. | |
| 2005/0156390 | A1 * | 7/2005 | Marini et al. | 279/74 |

FOREIGN PATENT DOCUMENTS

| | | |
|---|---|---|
| CN | 200410088827 | 10/2006 |
| CN | 200820161342.1 | 8/2009 |
| WO | 2006/008546 A2 | 1/2006 |

* cited by examiner

*Primary Examiner* — Brian D Nash
*Assistant Examiner* — Michelle Lopez
(74) *Attorney, Agent, or Firm* — Greenberg Traurig, LLP

(57) ABSTRACT

An auto hammer having a housing, a grip portion and a striking device. The striking device includes a striking rod for striking a nail or other element using a straight reciprocating motion. The striking device has an associated clamping mechanism for clamping the nail or other element. The clamping mechanism has a driving portion, a first clamping portion, and a second clamping portion. The first and second clamping portions are moved between a closed position and an opened position. In the closed position, the element is held between the first and second clamping portions. A first slot and a second slot are arranged on the first and second clamping portions respectively. The driving portion is arranged in both the first and second slots and moves along the first and second slots.

17 Claims, 6 Drawing Sheets

CLAMPING MECHANISM FOR AN AUTO HAMMER

BACKGROUND

Auto hammers are commonly used tools in the fields of decoration and fitment. For example, the Chinese patent invention No. 200820161342.1 discloses an auto hammer, which comprises a housing and a nozzle portion being connected to the housing. The nozzle portion is generally composed of a hollow cylindrical sleeve, and a hole within which the magnet is arranged is drilled in the sleeve. The magnet is engaged in the hole so as to attract the nail placed in the striking device, so that the nail can be clamped. The existent defects of this arrangement are that: the magnet is located at the edge of the sleeve so that the nail could not be located at the center of the sleeve and parallel to the center line of the sleeve (namely the nail is skew after being attracted), moreover, the magnet could not clamp other nonmagnetic materials such as tenons and the like.

SUMMARY

An auto hammer having easy operation, good visibility and compact structure is provided. The auto hammer comprises a striking device having a clamping mechanism, the clamping mechanism comprising at least one driving portion, a first clamping portion and a second clamping portion. The first and second clamping portions are moved between a closed position and an opened position. At the closed position, elements are held between the first and second clamping portions. A first slot and a second slot are arranged on the first and second clamping portions respectively. The driving portion is arranged in both the first and second slots and moves along the first and second slots. The clamping portions can hold the shaft of the nail in a wide scope so that the clamping effect is better.

Further, the clamping mechanism may further comprise a sliding element through which the driving portions may pass, so that the sliding element is movable with respect to the first and second clamping portions.

Further, the clamping portions comprise round portions and grooves. A clamping area is formed when the grooves are engaged with the elements. A releasing area is formed when the grooves are separated from the elements.

Further, the first and second slots are arranged as fold-line type, which is propitious to shorten the stroke of the sliding element so that the structure could be more compact.

Further, a spanner is provided on the sliding element, and the auto hammer further comprises a housing. The spanner can lead the sliding element to retractably move towards the housing so as to open the clamping portions.

Further, the striking device comprises a striking rod which can pass through the releasing area.

Further, the clamping mechanism comprises a first biasing device for biasing the sliding element towards the first and second clamping portions.

Further, the clamping mechanism comprises a second biasing device for biasing the first and second clamping portions towards the striking end of the striking rod.

Further, the first and second clamping portions can be interlocked so as to be propitious to open or close the clamping portions simultaneously.

Further, the sliding element comprises a locking mechanism which comprises at least one protrusion and a spanner. When one protrusion is locked with the spanner, the clamping portions are located at the opened position. When the other one protrusion is locked with the spanner, the striking rod is exposed from the sliding element.

Further, the striking rod applies the striking force to the element to move it, and a transmission mechanism is used to convert the rotary motion of the motor to the straight reciprocating motion of the striking rod.

Further, the striking rod strikes the element several times so that the element gradually enters into the workpiece.

Further, the transmission mechanism comprises an impact wheel which comprises at least one protrusion for applying a periodically impacting action to the striking rod.

BRIEF DESCRIPTION OF THE DRAWINGS

The detailed embodiments of the present invention are described below in connection with the accompanied drawings in which.

DETAILED DESCRIPTION

Figure 1:
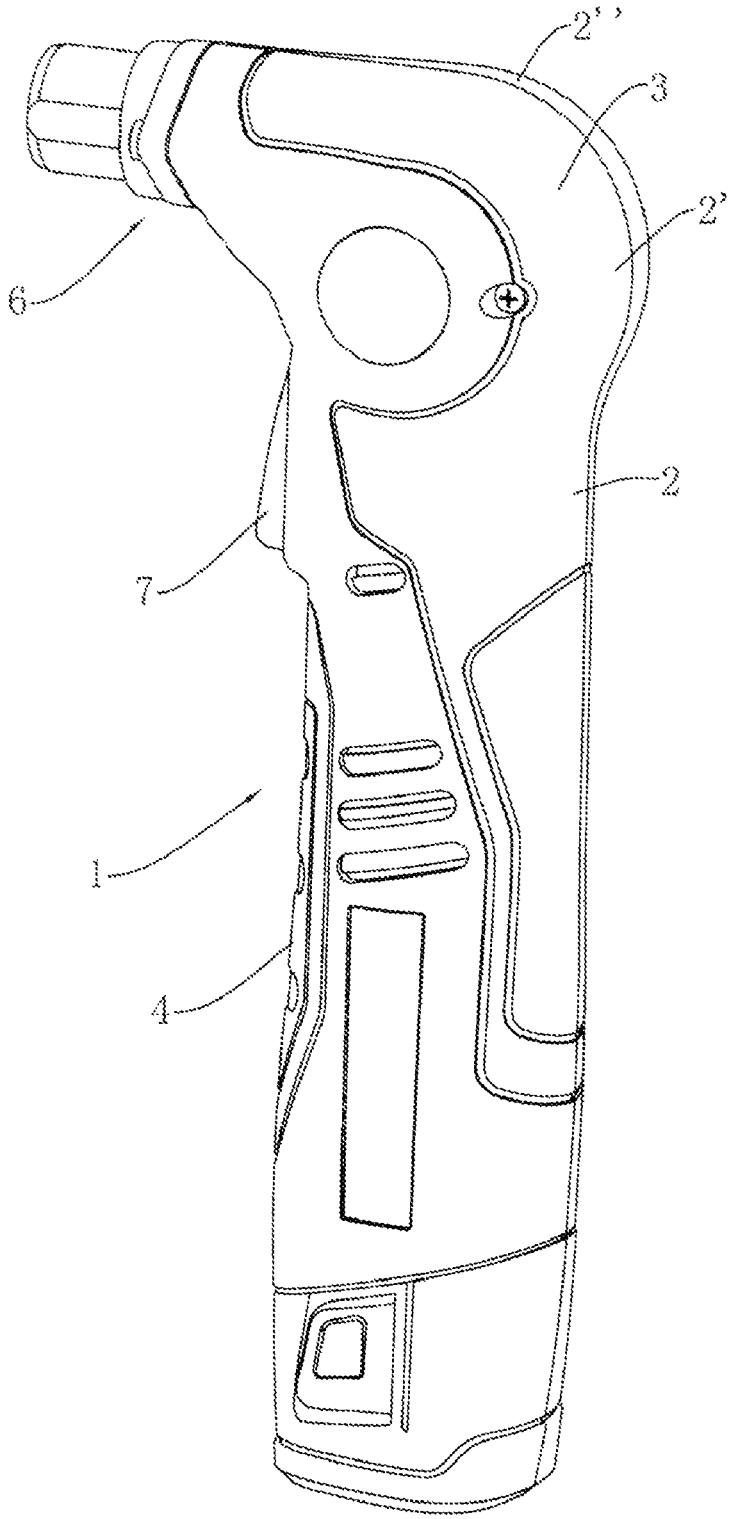
FIG. 1 is a perspective view of an auto hammer according to present invention.

As shown in FIGS. 1-4, the auto hammer 1 of the present embodiment comprises a housing 2 containing a motor M and a striking device 6. The housing 2 is composed with a first half housing 2' and a second half housing 2". A substantially vertical grip portion 4 is formed by a main body of the housing 2, and the upper portion thereof comprises a head assembly 3 which comprises a transmission mechanism and a striking device 6 formed by forward projecting.

In the present embodiment, the auto hammer 1 comprises a battery pack for powering the motor M. However, the auto hammer according to the present invention need not be restricted to the use of a DC power supply and may be equally powered by a source of AC power. A switch 7 is arranged on the housing 2 for controlling the motor M. The striking device 6 comprises a substantially horizontal striking rod 61 which is mounted in the striking device 6 by spring and moves in a straight reciprocating motion therein. During the operation, the end face of the striking end 611 of the striking rod 61 acts on the components such as fastening pieces like nails, tenons, etc. The striking device 6 may further comprise a receiving cavity 63, its inner diameter is bigger than the diameter of the common nails or other elements, thus nails or other elements with different shapes and sizes can be put into the receiving cavity 63.

Figure 4:
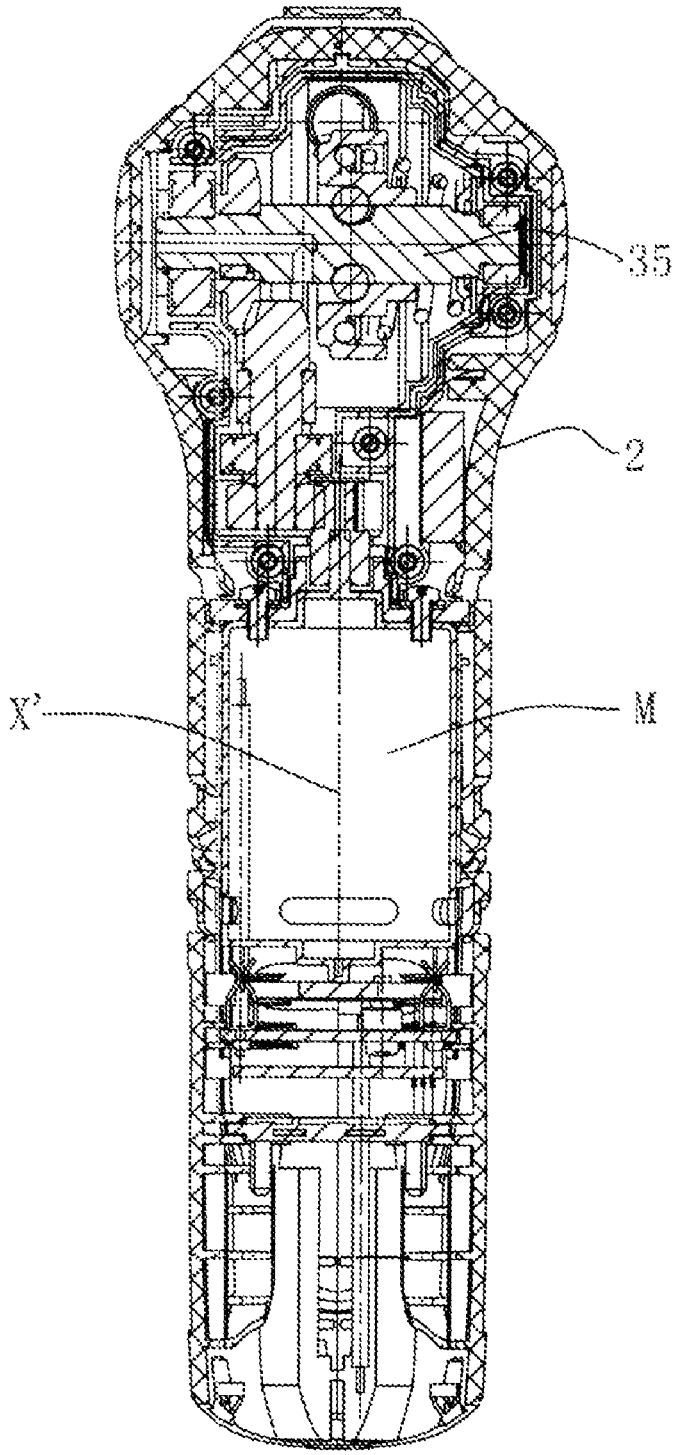
FIG. 4 is a cut-away view of the auto hammer as illustrated in FIG. 1 taken along the surface which is perpendicular to the combination surface of the two half housings, wherein the battery pack is removed.
Figure 5:
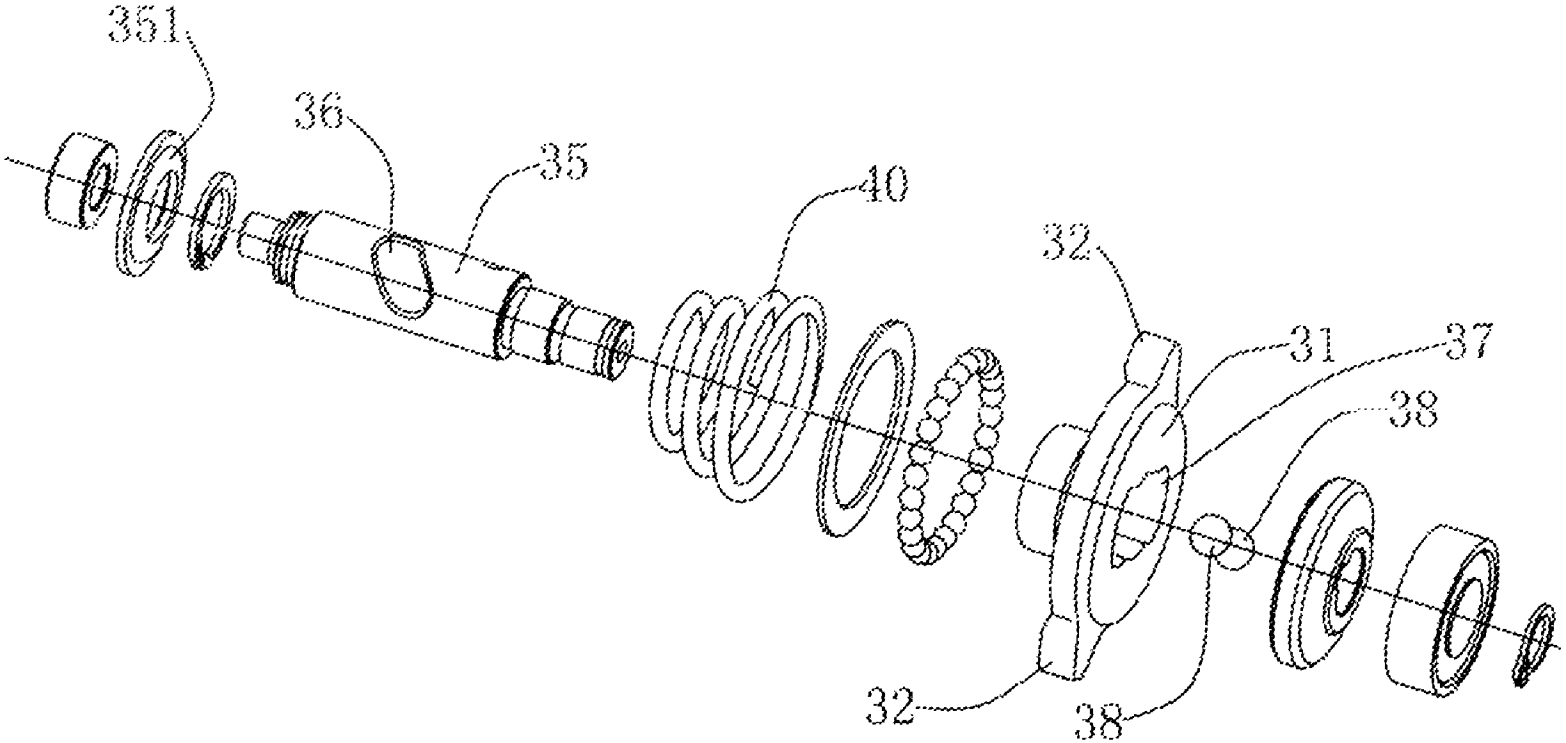
FIG. 5 is a partial exploded view of the transmission mechanism of the auto hammer in FIG. 1.

As shown in FIGS. 4-5, a rotary-linear motion transmission mechanism is arranged in the housing 2 for converting rotating motions of the motor M into impact motions of the striking rod 61. The motor M is mounted in the housing 2 in a longitudinal direction, with an upward motor shaft X' thereof transmitting the rotation power to a rotating shaft 35, by means of a multi-stage gear transmission mechanism including bevel gears. The rotating shaft 35 is mounted in the upper portion of the housing by two bearings. A pair of inclined slots 36 is formed on the rotating shaft 35, and each inclined slot 36 is formed as "V-shaped" with opening backwards. An impact wheel 31 is mounted on the rotating shaft 35. The impact wheel 31 is substantially formed as a hollow cylinder, and a pair of arc guiding slots 37 is formed on inner cylindrical surface thereof and opposite to the inclined slots 36 respectively. The opening direction of each guiding slot 37 is opposite to the "V-shaped" inclined slot 36. Both the inclined slots 36 and the guiding slots 37 have the bottom with the semicircle arc. A pair of steel balls 38 is arranged respectively in the chambers formed by the inclined slots 36 and the guiding slots 37 and can be moved with respect to the inclined slots 36 and the guiding slots 37. The impact wheel 31 can thus be driven to rotate through the steel balls 38 located in the inclined slots 36 when the rotating shall 35 is rotated. A pair of projections 32, which is disposed oppositely along the diameter direction of the impact wheel 31, is provided on the outer periphery of the impact wheel 31. When the switch 7 is turned on, the motor M is powered to drive the rotating shaft 35 to rotate by the transmission, of the multi-stage gear, and then the impact wheel 31 is rotated together with the rotating shaft 35 via the steel balls 38.

As shown in FIG. 5, an energy storing spring 40 is mounted between the impact wheel 31 and the rotating shaft 35 in such a manner that one end of the energy storing spring 40 abuts to a shoulder 351 of the rotating shaft 35 and the other end of the energy storing spring 40 abuts to a side surface of the impact wheel 31. Under an axial biasing force of the energy storing spring 40 acting upon the impact wheel 31 along the axial direction of the rotating shaft 35, the impact wheel 31 is located at a first axial position relative to the rotating shaft 35. In the first axial position, the impact wheel 31 rotates in a circle by means of the rotating shaft 35 and the steel balls 38. When the impact wheel 31 is rotated to a position where the projections 32 contact the striking rod 61, and the striking rod 61 encounters a larger resistance that is difficult to be overcome provisionally, the impact wheel 31 is temporarily stopped from rotating by the striking rod 61, so that the impact wheel 31 gradually compresses the energy storing spring 40 and moves from the first axial position to a second axial position. At the second axial position, the projection 32 of the impact wheel 31 departs from the striking rod 61, and the stopping is released. In this case, the energy storing spring 40 starts to release its elastic potential energy. Under a function of rebound axial force of the energy storing spring 40, the impact wheel 31 is pressed back to its first axial position quickly, and is moved at a higher speed than that of the rotating shaft 35 under the cooperation of the inclined slots 36, the guiding slots 37 and the steel balls 38. As a result, the stricken end 612 of the striking rod 61 is impacted by the projections 32 on the impact wheel 31 to move at a high speed in a linear motion. In this way, a strike action is achieved. After the first strike action achieved, when the impact wheel 31 is continuously driven to rotate to be stopped by the striking rod 61, it enters into succeeding cycles, which will be achieved in the same manner.

As shown in FIGS. 2-3 and FIGS. 6-7, the striking device 6 may further comprise a clamping mechanism 5 for clamping a nail or other elements. The clamping mechanism 5 is formed as clamping portions 52*a* and 52*b* which are mounted in the main body 51 of the clamping mechanism 5. Inclined slots 521 and 521' having identical shape are provided on each side of the clamping portion 52*a* respectively. Also, inclined slots 522, 522' are horizontally symmetrical with the inclined slots 521 and 521' provided on each side of the clamping portion 52*b* respectively. All of the inclined slots provided on the clamping portions 52*a* and 52*b* are fold-line shaped so as to shorten the stroke of the sliding element (the sliding element will be described in detail below), so that the structure may be more compact. The fold-line inclined slots herein include slots such as arc slots, slots formed by two or more lines with various slopes and the like. The grooves 523 and round portions 524 as shown in the figures are provided on each clamping portion. When the clamping portions are located in the closed position, these grooves form a clamping area to engage with the shank of the nail or other elements, so that the nail can be retained in the receiving cavity 63. When the clamping portions are totally located at the opened position, these grooves are separated from the nail or other elements to form a releasing area, and these round portions are concentric with each other. This arrangement prevents the nail from being blocked in the clamping mechanism 5 and allows the striking rod 61 to pass through the clamping portions to strike the nail continuously.

The clamping portions can be any one or combination of claw, spring, magnet, bolt or chuck for retaining elements.

During, assembly, the clamping potions 52*a* and 52*b* are installed in the main body 51 after intercalating with each other. The driving portion 53*a* passes through the inclined slots 521 and 522 respectively to be installed on the sliding element 8. The driving portion 53*b* passes through the inclined slots 521' and 522' respectively to be installed on the sliding element 8. The driving portions 53*a* and 53*b* may slide in their corresponding inclined slots so as to drive the clamping portions to move upward or downward. A locking portion 18 is installed in the main body 51 by a spring. The locking portion 18 can lock the main body 51 on the support 17. A ferrule 10 is slidable with one end thereof is installed on the housing 2, and the other end is fixed on the main body 51, so that the main body 51 and the ferrule 10 may slide together. A steel wire ring 19 is installed in a recess 8*a* of the sliding element 8, so that the sliding element 8 can be stopped on the shoulder of the main body 51.

Figure 9:
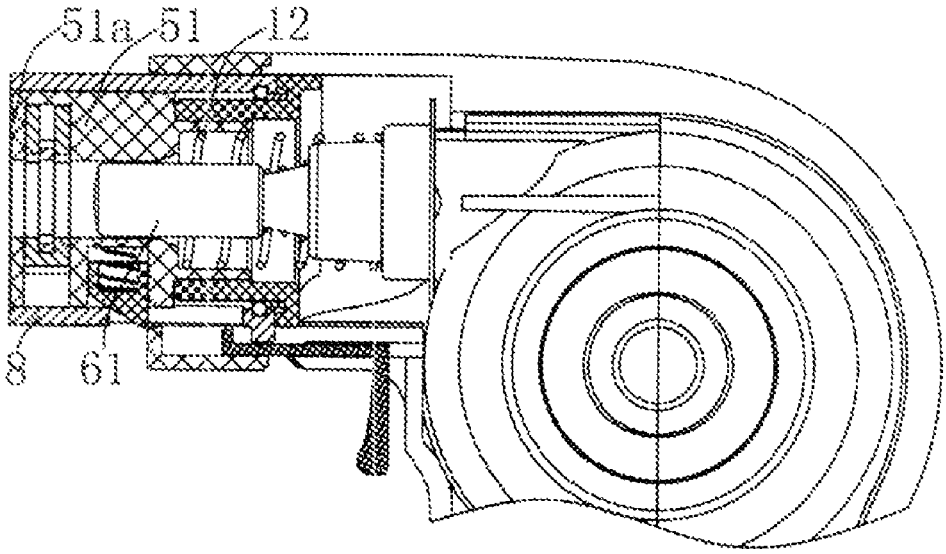
FIG. 9 is a cut-away view of the clamping mechanism of the auto hammer as illustrated in FIG. 1 taken along the combination surface of the two half housings, wherein the clamping portions are located at the opened position.
Figure 10:
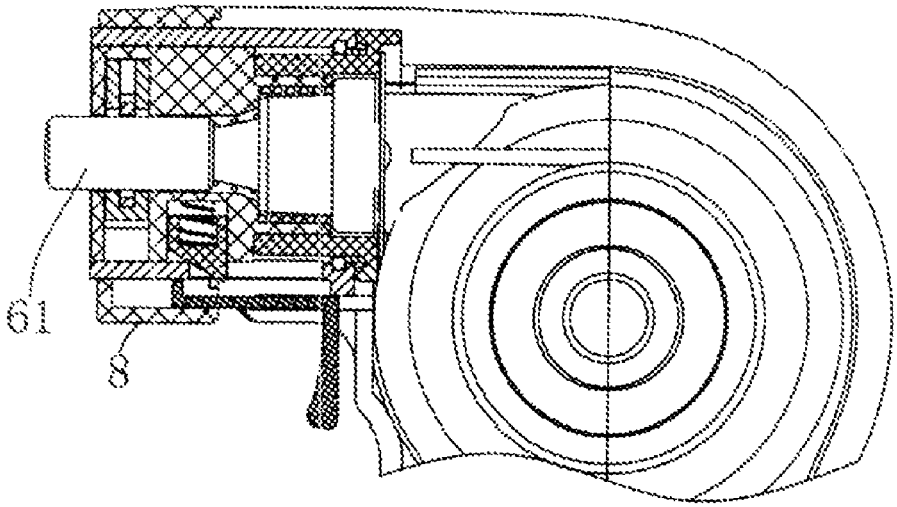
FIG. 10 is a cut-away view of the clamping mechanism of the auto hammer as illustrated in FIG. 1 taken along the combination surface of the two half housings, wherein the striking rod is exposed from the sliding element.

A first biasing device is provided in the form of spring 11 for biasing the sliding element 8 against the shoulder of the main body 51 towards the first and second clamping portions, so as to make the clamping portions located at the closed position. One end of the spring 11 is installed on the sliding element 8 and the other end is installed on the ferrule 10. When the sliding element 8 contacts the workpiece, the user needs to overcome the pressure from the first biasing device to open the clamping portions. A second biasing device is provided in the form of spring 12 for biasing the first and second clamping portions towards the striking end 611 of the striking rod 61. One end of the spring 12 is installed on the shoulder of the main body 51 and the other end is installed on the gear case. When the end face 51*a* of the main body 51 contacts the workpiece (as shown in FIG. 9), the user needs to overcome the pressure from the second biasing device 12 to make the main body 51 and the sliding element 8 moved together. At this time, the clamping portions are located in the opened position and the striking rod 61 can pass through the clamping portions and strike the nail head continuously until the nail is totally nailed into the workpiece.

The above-mentioned springs may be compression springs or coil springs. Such springs may be replaced by other biasing devices with elasticity or having attraction tierce, repulsive force, such as the magnetic portion can be used to replace the spring 11 or 12.

Figure 2:
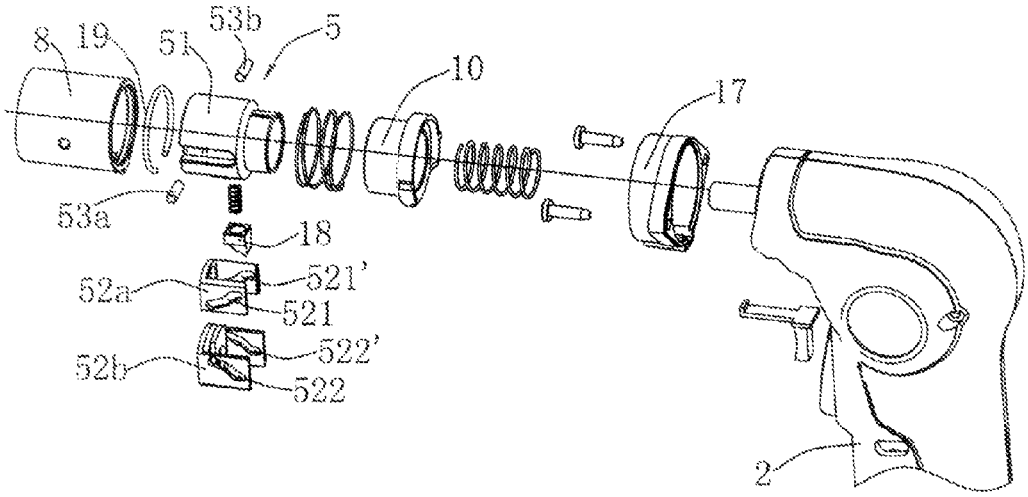
FIG. 2 is an explode view of the clamping mechanism of the auto hammer as illustrated in FIG. 1.
Figure 3:
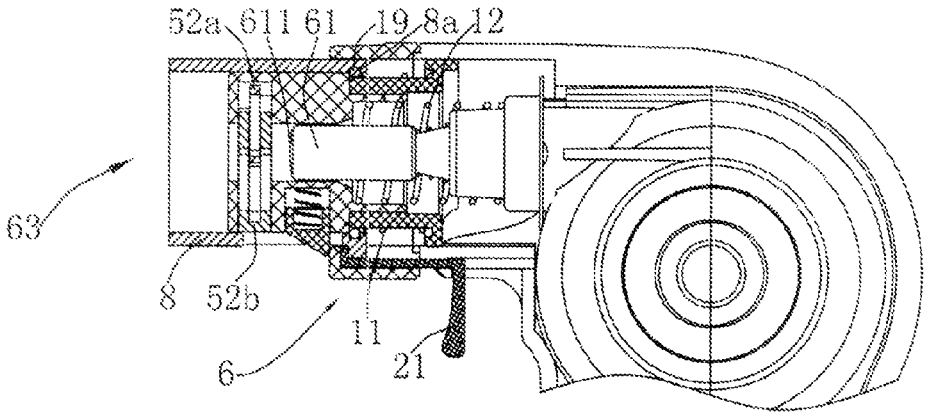
FIG. 3 is a cut-away view of the clamping mechanism of the auto hammer as illustrated in FIG. 1 taken along the combination surface of the two half housings, wherein the clamping portions are located at the closed position.
Figure 6:
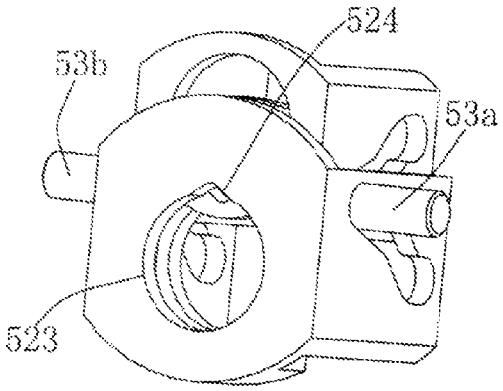
FIG. 6 is a perspective view of the clamping mechanism of the auto hammer in FIG. 2, wherein two clamping portions are located at the closed position.
Figure 7:
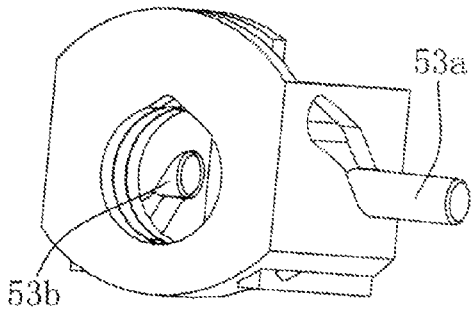
FIG. 7 is a perspective view of the clamping mechanism of the auto hammer in FIG. 2, wherein two clamping portions are located at the opened position.
Figure 8:
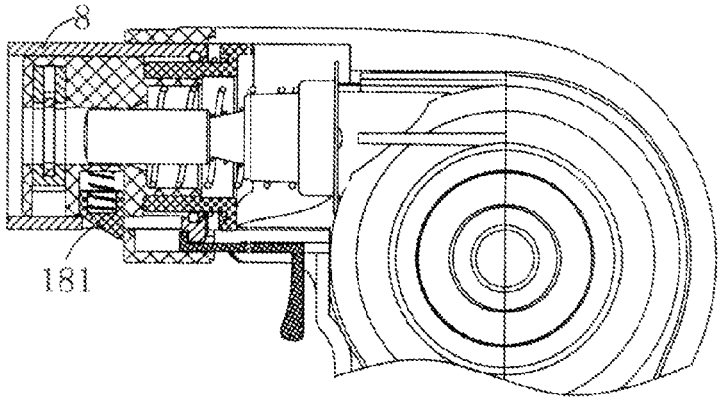
FIG. 8 is a cut-away view of the clamping mechanism of the auto hammer as illustrated in FIG. 1 taken along the combination surface of the two half housings, wherein the sliding element engages with the inclined surface of the locking portion.

During the operation, if the clamping portions are located in the closed position, that is, the driving portions 53*a* and 53*b* are located at the first position, as shown in FIGS. 2 and 6, the sliding element 8 is driven to move retractably towards the housing by turning the spanner 21 arranged on the sliding element, such that the clamping portions are opened and the nail could be arranged into the receiving cavity 63. Then, the spanner 21 is released such that the nail is held by the clamping portions independently. Subsequently, the nail may be adjacent to the workpiece by positioning the auto hammer. The switch 7 is then pressed down for powering the motor M and the striking rod 61 can move in reciprocating manner. When the user pushes the auto hammer on the workpiece, the nail head is struck continuously by the striking rod 61, so that the nail is gradually inserted into the workpiece. During the gradually insertion of the nail, the main body 51 is fixed on the support 17 by the locking portion 18 when the sliding element 8 engages with the workpiece, and the user needs to overcome the pressure from the spring 11 to open the clamping portions. This allows the nail to be partially nailed into the workpiece before being released. When the sliding element 8 is moved to engage with the inclined surface 181 of the locking portion 18, as shown in FIGS. 7-8, the clamping portions are in the opened position, that is, the driving portions 53*a* and 53*b* are located at the second position, and the round portions of the clamping portions 52*a* and 52*b* are concentric with each other. This arrangement efficiently prevents the nail from being blocked in the clamping mechanism and allows the striking rod 61 to pass through the clamping portions to strike the nail continuously. Subsequently, the sliding element 8 continues to move, the locking portion 18 is gradually retracted into the recess of the main body 51 and is separated from the support 17, as shown in FIG. 9. At this time, the user needs to overcome the pressure from the second biasing device so that the main body 51 and sliding element 8 may move together. The striking rod 61 can pass through the clamping portions to continuously strike the nail, and the striking rod 61 can be exposed from the sliding element 8 until the nail is totally nailed into the workpiece.

After completely striking one nail or other elements, the sliding element is returned to the closed position of the clamping portions under the action of the biasing element. If another nail or other elements is required to be struck again, the above-mentioned steps may be repeated to achieve the second striking. Certainly, a locking mechanism may be further provided on the sliding element 8, for example, two protrusions are provided on the sliding element for engaging with the spanner of a locking mechanism arranged on the housing. When one protrusion engages with the spanner, the sliding element 8 is locked at the opened position of the clamping portions. When the other protrusion engages with the spanner, the sliding element is locked such that the striking rod 61 can be exposed from the sliding element to enhance the visibility of the striking rod 61. At this time, the striking end 611 of the striking rod 61 can act as the knocking portion of the auto hammer. During the operation, the striking end 611 knocks the workpiece to be processed, such as tenons, bricks and the like, with the straight reciprocating motion of the striking rod 61, such that the function of this machine can be extended without limiting the function for nailing the fastening elements into the workpiece. Based on the present embodiment, the sliding element 8 may be formed of transparent materials such as transparent plastic and the like to enhance the visibility of the striking rod 61. When the user observes the concrete position of the striking rod 61, he could use the auto hammer to knock the workpiece to be processed.

In conclusion, the auto hammer described in this invention is not limited to the embodiments described above and the configurations shown in the drawings. There are many obvious variations, substitutes and modifications in the shapes and locations of the components based on the present invention, and such variations, substitutes and modifications shall all fall in the scope sought for protection in the present invention.

What is claimed is:

1. An auto hammer, comprising:

a striking device having a clamping mechanism, the clamping mechanism comprising:

a driving portion, a first clamping portion, and a second clamping portion, wherein the first and second clamping portions are moved between a closed position and an opened position such that, in the closed position, an element is held between the first and second clamping portions, and wherein the first clamping portion comprises a first slot and the second clamping portion comprises a second slot with the driving portion being arranged in both the first and second slots to thereby move along the first and second slots.

2. The auto hammer of claim 1, wherein the clamping mechanism further comprises a sliding element and the driving portion passes through the sliding element so that the sliding element is movable with respect to the first and second clamping portions.

3. The auto hammer of claim 2, wherein a spanner is provided on the sliding element and the auto hammer comprises a housing whereby the spanner leads the sliding element to retractably move towards the housing to open the clamping portions.

4. The auto hammer of claim 2, wherein the clamping mechanism comprises a first biasing device for biasing the sliding element towards the first and second clamping portions.

5. The auto hammer of claim 1, wherein the clamping portions comprise round portions and grooves and a clamping area is formed when the grooves are engaged with the element and a releasing area is formed when the grooves are separated from the element.

6. The auto hammer of claim 5, wherein the striking device further comprises a striking rod which passes through the releasing area.

7. The auto hammer of claim 6, wherein the striking rod applies the striking force to the element to move it and a transmission mechanism is used to convert rotary motion of a motor to a straight reciprocating motion of the striking rod.

8. The auto hammer of claim 7, wherein the striking rod strikes the element several times so that the element gradually enters into the workpiece.

9. The auto hammer of claim 7, wherein the transmission mechanism comprises an impact wheel which comprises at least one protrusion for applying periodic impacting action to the striking rod.

10. The auto hammer of claim 5, wherein the clamping mechanism comprises a second biasing device for biasing the first and second clamping portions towards a striking end of the striking rod.

11. The auto hammer of claim 1, wherein the first and second slots are arranged as fold-line slots.

12. The auto hammer of claim 1, wherein the first and second clamping portions are interlocked.

13. The auto hammer of claim 1, wherein the striking device further comprises a locking mechanism.

14. The auto hammer of claim 13, wherein the locking mechanism comprises at least one protrusion and a spanner.

15. The auto hammer of claim 14, wherein the clamping portions arc located at the opened position when one protrusion is locked with the spanner.

16. The auto hammer of claim 14, wherein a striking rod is exposed from the striking device when one protrusion is locked with the spanner.

17. The auto hammer of claim 1, further comprising:

a second driving portion, wherein the first clamping portion comprises a second first slot and the second clamping portion comprises a second second slot with the second driving portion being arranged in both the second first slot and the second second slot to thereby move along the second first slot and the second second slot.

* * * * *